United States Patent [19]

Capek et al.

[11] 4,453,153

[45] Jun. 5, 1984

[54] BLEEDER RESISTOR FOR ANTENNA ISOLATOR

[75] Inventors: Raymond G. Capek, Elmhurst; Elgie Garrett, Chicago, both of Ill.

[73] Assignee: Zenith Radio Corporation, Glenview, Ill.

[21] Appl. No.: 376,460

[22] Filed: May 10, 1982

[51] Int. Cl.[3] ..... H01C 1/012

[52] U.S. Cl. ..... 338/309; 219/543; 219/551; 333/12; 339/147 C; 343/700 R

[58] Field of Search ..... 338/60, 20, 308, 309; 333/12, 185, 245; 339/147 C; 343/700 R; 219/543, 551

[56] References Cited

U.S. PATENT DOCUMENTS

| | | | |
|---|---|---|---|
| 4,069,465 | 1/1978 | Kouchich | 338/20 |
| 4,267,529 | 5/1981 | Brun et al. | 333/12 |
| 4,310,812 | 1/1982 | DeBloois | 333/81 A |
| 4,399,419 | 8/1983 | Dobrovolny | 333/12 |

*Primary Examiner*—Volodymyr Y. Mayewsky

[57] ABSTRACT

A bleeder resistor is described for draining charge from capacitances formed in a three element isolator. The isolator includes a dielectric element having conductive coatings thereon to form a capacitance. A bleeder resistor is formed on the dielectric element by screening a thick film resistive composition on the dielectric element so as to create a discharge path between conductive coatings on the dielectric element.

3 Claims, 4 Drawing Figures

BLEEDER RESISTOR FOR ANTENNA ISOLATOR

BACKGROUND OF THE INVENTION

This invention is generally directed to improvements in antenna isolators. It is particularly directed to a method of fabricating a bleeder resistor for use in such an isolator.

It is now widely recognized that isolation should be provided between a television receiver's tuner and the cable which carries the television signal to the tuner. With such isolation, any power line voltage which may appear on the tuner is inhibited from reaching the cable input to the tuner. Potential shock hazards to one who touches the cable input are thus eliminated.

A preferred type of isolator is disclosed in U.S. application Ser. No. 282,824, filed July 13, 1981, now U.S. Pat. No. 4,399,419, and assigned to the assignee of the present invention. Briefly, the above-referenced application discloses a small isolator which includes a pair of dielectric elements which sandwich a ferrite element. The three elements may be built into a cable, or into a connector for the cable, such that the dielectric elements provide a capacitive coupling for the desired television signal and simultaneously inhibit the conduction of AC power line currents. The ferrite element absorbs ambient electromagnetic interference to protect the transmitted field within the cable. A small but reliable housing for the three element isolator described above is a connector assembly or plug.

To remove accumulated charge from the capacitors formed by the dielectric elements, a bleeder resistor may be included as part of the isolator. However, problems arise in attempting to include a suitable bleeder resistor in the isolator's housing.

First, the resistor must necessarily occupy very little space if it is to be contained within a plug. Secondly, the value of the resistor should not change substantially as a function of voltage across it. These two criteria make it difficult to use a conventional discrete resistor as a bleeder. In addition, any such bleeder resistor must withstand relatively high operating voltages and test voltages to meet existing safety standards. Equally desirable is the ability to manufacture the bleeder resistor easily in high volume production.

Accordingly, it is a general object of the invention to provide an improved method of fabricating a bleeder resistor for use in an antenna isolator.

It is a more specific object of the invention to provide a method of economically fabricating a very small bleeder resistor whose value does not change substantially as a function of applied voltage, and which can withstand relatively high test voltages and operating voltages.

BRIEF DESCRIPTION OF THE FIGURES

The objects stated above and other objects of the invention are set forth more particularly in the following detailed description and in the accompanying drawings, of which.

DESCRIPTION OF THE PREFERRED EMBODIMENT

Figure 1:
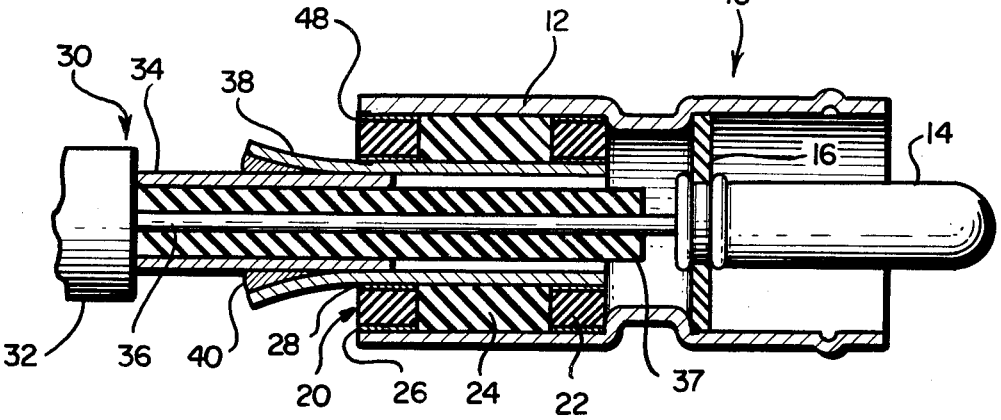
FIG. 1 is a sectional view of a plug which houses a three element isolator to illustrate the use to which the present invention may be put.

Referring to FIG. 1, a connector or plug 10 is shown of the type which preferably houses a three element isolator of the type disclosed above. The plug 10 includes an outer conductive shell 12, a pin 14, and an annular insulating support 16 to support the pin 14.

The three element isolator housed within the plug includes a first annular dielectric element 20, a second annular dielectric element 22, and a hollow, cylindrical ferrite element 24 sandwiched between the dielectric elements.

The dielectric element 20 has an outer circumference which is covered with a conductive coating 26. A central aperture through this dielectric element forms an inner circumference which is covered by another conductive coating 28. Similar conductive coatings cover the inner and outer circumferences of the dielectric element 22.

A television signal may be carried to or from the plug 10 by a cable 30. This cable may include an outer cover 32, a conductive shield 34 a dielectric element 37, and an inner conductor 36. As shown, the cable's inner conductor 36 extends through central apertures in the dielectric elements 20 and 22 and the ferrite element 24 to be coupled directly to the pin 14.

A hollow, generally cylindrical sleeve 38 receives the cable's shield 34 such that the sleeve 38 is disposed between the shield 34 and the conductive coatings on the inner circumferences of the dielectric elements 20 and 22. A solder joint 40 may join the sleeve 38 to the shield 34. Thus, the dielectric elements 20 and 22 and their respective conductive coatings form capacitors which capacitively couple the shield 34 to the shell 12. The values of these capacitors are selected to couple television frequency signals between the shell 12 and the shield 34, but to block AC line frequencies. Thus, the shield 34 is isolated from the shell 12 at AC power line frequencies.

As previously stated, existing safety standards require that charges be dissipated from the capacitors formed by the dielectric elements 20 and 22 and their conductive coatings. Accordingly, a bleeder resistor must be included to drain charge from these capacitors without interfering with the function of the three element isolator.

Figure 2:
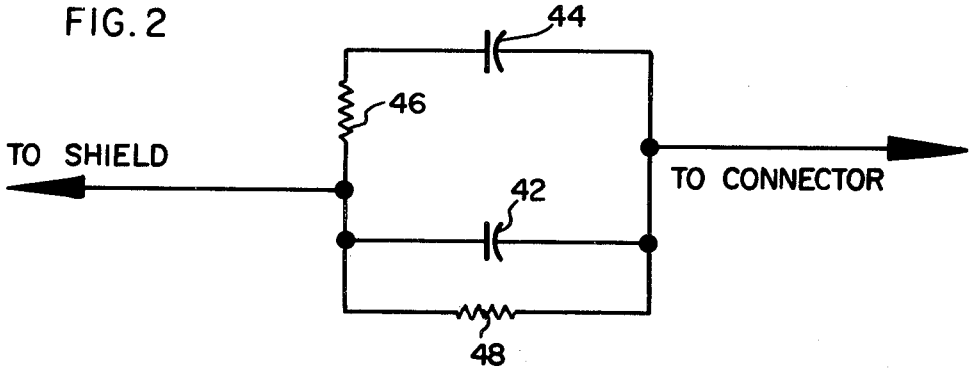
FIG. 2 illustrates an equivalent electrical circuit of the three element isolator and a bleeder resistor which is constructed according to the invention.

To more fully describe the function of the bleeder resistor, reference is made to FIG. 2 which is an electrical equivalent circuit of the isolator, including a bleeder resistor. Capacitors 42 and 44 represent the capacitances formed by the dielectric elements 20 and 22 and their conductive coatings. A resistor 46 represents the ferrite element 24, and another resistor 48 is a bleeder resistor. With the resistor 48 coupled in parallel with the capacitor 42, charge which collects on this capacitor will be drained therefrom by the bleeder resistor 48. Likewise, charge will be drained from the capacitor 42 by the resistor 48.

To form the resistor 48, it is preferred to modify the dielectric element 20 so that it carries a resistive composition which is screened on to form a bleeder resistor, and such that the resultant bleeder resistor is the electrical equivalent of the resistor 48. The manner in which this is accomplished will now be described.

Figure 3:
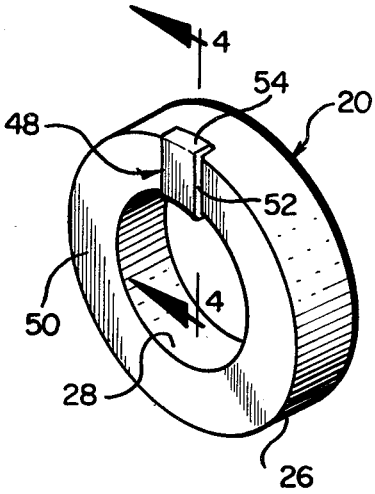
FIG. 3 is a perspective view of a dielectric element of the three element isolator and a bleeder resistor formed thereon is accordance with the invention.
Figure 4:
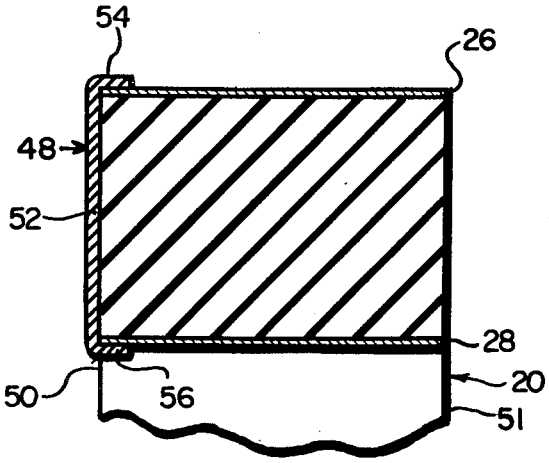
FIG. 4 is a view taken along lines 4—4 of FIG. 3.

Turning now to FIGS. 3 and 4, the dielectric element 20 is illustrated in more detail. As shown, its conductive coating 26 covers its entire outer circumference and the conductive coating 28 covers its entire inner circumference. No such coating covers its end face 50 or its opposing end face 51.

The bleeder resistor 48 is formed by a thick film resistive composition whose thickness is shown greatly enlarged in FIG. 3. This composition is configured to form a strip 52 which extends across the dielectric element's end face 50. The ends of the strip 52 extend perpendicularly to the plane of the end face 50 so as to form fingers 54 and 56 which overlie and make good ohmic contact with the conductive coatings 26 and 28. Thus, a resistive discharge path is formed between the coatings 26 and 28. When the dielectric element 20 is disposed within the plug 10 as shown in FIG. 1, the bleeder resistor 48 provides the discharge paths illustrated in FIG. 2.

The dielectric element 20 and its bleeder resistor 48 may be fabricated as follows. Starting with a barium titanate dielectric annulus having the shape shown in FIG. 3 (excluding the resistor 48), a layer of nickel is chemically deposited over its inner and outer circumferences to a depth of about 0.1 mil, for example. A layer of silver is then electroplated over the nickel to a depth of about 0.4 mils. The combined layers of nickel and silver constitute the conductive coatings 26 and 28.

The resistor 48 is formed by screening any suitable thick film resistive composition, such as DuPont 9884 composition, onto the end face 50 to form the strip 52 and by simultaneously screening the same material onto the conductive coatings 26 and 28 to form the fingers 54 and 56. In the screening operation, the screen is apertured to permit the resistive composition to overlap the conductive coatings 26 and 28 to simultaneously form the strip 52 and the fingers 54 and 56.

After screening, the dielectric element and its accompanying bleeder resistor are baked by slowly elevating their temperature to about 880° C., holding that temperature for about 10 minutes, and then slowly cooling them to room temperature for a total time of about 45 minutes.

The advantages of this bleeder resistor are that it occupies very little space and has a relatively constant value of resistance as the voltage across it changes. In addition, its relatively low cost makes it attractive for high volume production.

Although the invention has been described in terms of preferred steps and structures, it will be obvious to those skilled in the art that many alterations and variations may be made without departing from the invention. Accordingly, it is intended that all such alterations and variations be considered as within the spirit and scope of the invention as defined by the appended claims.

What is claimed is:

1. A combined dielectric element and bleeder resistor for an isolator, comprising:

an annular dielectric element having an inner circumference, an outer circumference, and a pair of end faces;

a first conductive coating on the dielectric element's inner circumference and a second conductive coating on the dielectric element's outer circumference; and a resistor composition formed on the dielectric element such that a narrow strip of resistor composition overlies one of the end faces and extends at both its ends in a direction perpendicular to the one end face so as to contact the conductive coatings on the dielectric element's inner and outer circumferences.

2. A combined dielectric element and bleeder resistor as set forth in claim 1 wherein said resistor composition comprises a thick film resistor composition screened onto said dielectric element and fixed by baking it at a relatively elevated temperature.

3. A combined dielectric element and bleeder resistor as set forth in claim 2 wherein said first and second conductive coatings each comprises a layer of silver overlying a layer of nickel.

* * * * *